US007053347B1

(12) United States Patent
Lee et al.

(10) Patent No.: US 7,053,347 B1
(45) Date of Patent: May 30, 2006

(54) MICROWAVE OVEN AND CONTROL METHOD THEREOF

(75) Inventors: Won-woo Lee, Suwon-si (KR); Gun-su Kim, Suwon-si (KR); So-hyun Lee, Suwon-si (KR); Jong-chull Shon, Suwon-si (KR); Kum-chul Hwang, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/154,560

(22) Filed: Jun. 17, 2005

(30) Foreign Application Priority Data

Nov. 17, 2004 (KR) ..... 10-2004-0094322

(51) Int. Cl.
*H05B 6/68* (2006.01)

(52) U.S. Cl. ..... 219/707; 219/705; 219/719; 73/29.01; 99/325

(58) Field of Classification Search ..... 219/707, 219/702, 705, 710, 757, 719, 492; 73/29.01, 73/73; 99/325, 451
See application file for complete search history.

(56) References Cited

U.S. PATENT DOCUMENTS 5,445,009 A * 8/1995 Yang et al. ..... 73/29.01
6,538,240 B1 * 3/2003 Shon et al. ..... 219/707
2003/0146208 A1 * 8/2003 Lee et al. ..... 219/702

FOREIGN PATENT DOCUMENTS

| | | | |
|---|---|---|---|
| KR | 08-130087 | A | 5/1996 |
| KR | 2002-0042348 | A | 6/2002 |
| KR | 2002-0057127 | A | 7/2002 |
| KR | 10-0377722 | B1 | 5/2003 |
| KR | 2003-185145 | A | 7/2003 |
| KR | 2003-0079385 | A | 10/2003 |
| KR | 10-0420343 | B1 | 3/2004 |

* cited by examiner

*Primary Examiner*—Philip H. Leung
(74) *Attorney, Agent, or Firm*—Sughrue Mion, PLLC

(57) ABSTRACT

A microwave oven, having a humidity sensor and a voltage detecting unit for detecting a change in an output voltage of the humidity sensor, includes: a control unit for receiving a compensated voltage according to a change in temperature supplied from the humidity sensor and a detected voltage supplied from the voltage detecting unit, and determining a cooking time based on a voltage difference between the detected voltage and the compensated voltage. With this configuration, an optimal cooking time based on a being cooked can be calculated by use of the humidity sensor, and the cooking time can be controlled in a stable manner relative to external noise or irregular changes in humidity.

7 Claims, 4 Drawing Sheets

MICROWAVE OVEN AND CONTROL METHOD THEREOF

CROSS-REFERENCE TO RELATED APPLICATION

This application claims benefit from Korean Patent Application No. 10-2004-0094322, filed on Nov. 17, 2004, in the Korean Intellectual Property Office, the disclosure of which is incorporated herein in its entirety by reference.

BACKGROUND OF INVENTION

1. Field of Invention

The present invention relates to a microwave oven and a control method thereof, and more particularly, to a microwave oven capable of controlling a cooking time with the use of a humidity sensor and a control method thereof.

2. Description of the Related Art

When cooking with a microwave oven, a sensing means such as an infrared sensor or a humidity sensor may be used to control a cooking time. By way of example, where an infrared sensor is used, the infrared sensor can sense an internal temperature of a cooking chamber of the microwave oven and control the cooking time based on the sensed temperature. Where a humidity sensor is used, the humidity sensor can sense a humidity of steam discharged from the inside of the cooking chamber and control the cooking time based on the sensed humidity.

In a microwave oven employing a humidity sensor, the humidity sensor is generally constructed to sense a change in an amount of steam generated while a food is being cooked or a change in time during which the steam is generated, as a voltage value. In other words, the humidity from the steam generated during cooking by the microwave oven is sensed as a voltage value and the cooking time can be controlled according to the kind of food to be cooked, based on the sensed voltage value.

However, noise due to electromagnetic waves generated in a magnetron during a cooking operation of the microwave oven may affect the humidity sensor causing it to malfunction. Furthermore, generation of a derivation in measuring the voltage because of the inherent nature of the humidity sensor may cause a difficulty in controlling the optimal cooking time.

Additionally, where a user wishes to cook another food immediately after a food has finished cooking, the sensitivity of the humidity sensor may be deteriorated because the humidity sensor may not have cooled sufficiently. Even while a food is being cooked in the microwave oven under the condition that the steam inside the cooking chamber has not been completely discharged out and remains inside the cooking chamber, it may not be possible to accurately sense the humidity by use of the humidity sensor, thereby making it difficult to control the optimal cooking time for the concerned food.

SUMMARY OF THE INVENTION

Accordingly, it is an aspect of the present invention to provide a microwave oven capable of calculating the optimal cooking time of a food with the use of a humidity sensor, and a control method thereof.

The foregoing and/or other aspects of the present invention are also achieved by providing a microwave oven having a humidity sensor and a voltage detecting unit for detecting a change in an output voltage of the humidity sensor, the microwave oven comprising: a control unit for which receives a compensated voltage according to a change in temperature supplied from the humidity sensor and a detected voltage supplied from the voltage detecting unit, and determines a cooking time based on a voltage difference between the detected voltage and the compensated voltage.

According to an exemplary embodiment of the present invention, the control unit comprises: a voltage difference calculating unit which receives the compensated voltage according to a change in temperature supplied from the humidity sensor and the detected voltage supplied from the voltage detecting unit, and calculates the voltage difference between the detected voltage and the compensated voltage, a mean voltage calculating unit which measures the voltage difference supplied from the voltage difference calculating unit consecutively at a predetermined interval of time, and calculates a plurality of mean moved voltages; and a cooking time determining unit which determines a cooking time based on the minimum mean voltage (i.e., the voltage having the minimum value among the mean moved voltages) and a voltage fluctuation value set in advance based on a food being cooked.

According to an exemplary embodiment of the present invention, the cooking time determining unit comprises: a first time calculating unit which calculates a cooking time from when a food starts to be cooked until the mean moved voltage reaches a time figured out by the sum of the minimum mean voltage and the voltage fluctuation value set in advance; and a second time calculating unit which calculates a remaining cooking time by reflecting a predetermined weight according to the food in the cooking time calculated by the first time calculating unit.

According to an exemplary embodiment of the present invention, the control unit initially operates an exhaust fan for a predetermined period of time to exhaust the inside of the cooking chamber.

The foregoing and/or other aspects of the present invention are also achieved by providing a method of controlling a microwave oven having a humidity sensor and a voltage detecting unit for detecting a change in an output voltage of the humidity sensor, the method comprising: receiving a compensated voltage according to a change in temperature supplied from the humidity sensor; receiving a detected voltage supplied from the voltage detecting unit; calculating a difference between the detected voltage and the compensated voltage; measuring the voltage differences consecutively at a predetermined interval of time; measuring a plurality of mean moved voltages; and determining a cooking time based on a minimum mean voltage (i.e., the voltage having the minimum value among the mean moved voltages) and a voltage fluctuation value set in advance based on a food to be cooked.

According to an exemplary embodiment of the present invention, the method of controlling the microwave oven further comprises: calculating a cooking time from when a food starts to be cooked until the mean moved voltage reaches a time figured out by the sum of the minimum mean voltage and the voltage fluctuation value set in advance; and calculating a remaining cooking time by reflecting a predetermined weight according to the food in the calculated cooking time.

According to an exemplary embodiment of the present invention, the method of controlling the microwave oven further comprises exhausting an inside of a cooking chamber of the microwave oven by operating an exhaust fan for a predetermined period of time at the microwave oven's initial operation.

BRIEF DESCRIPTION OF THE DRAWINGS

The above and other aspects of the present invention will become apparent from the following description of exemplary embodiments given in conjunction with the accompanying drawings, in which.

DETAILED DESCRIPTION OF THE EXEMPLARY EMBODIMENTS OF THE INVENTION

Figure 1:
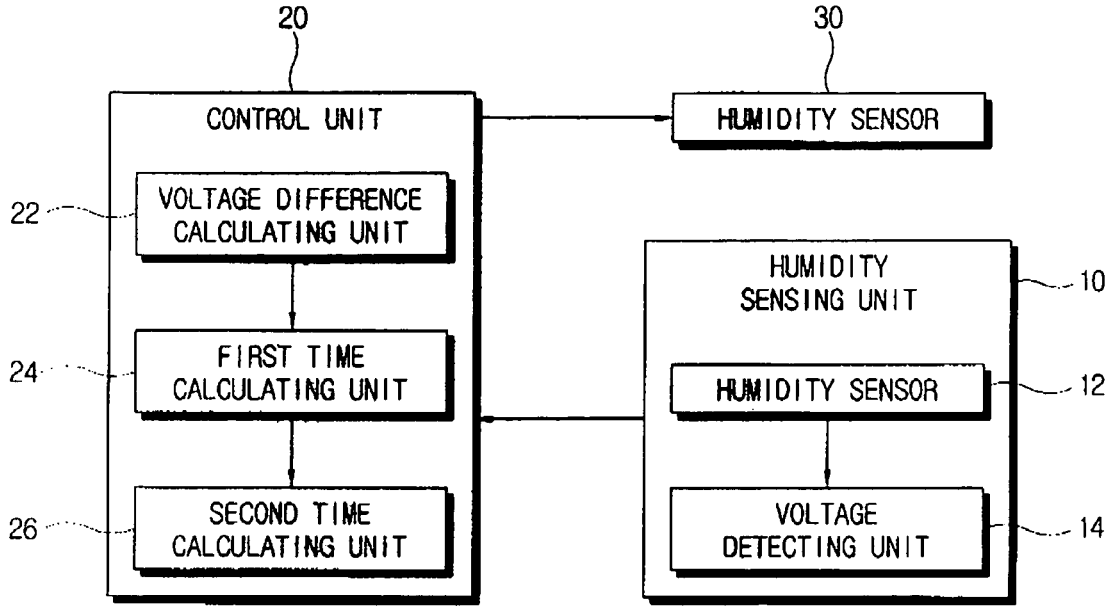
FIG. 1 is a block diagram illustrating sensing a humidity of a microwave oven according to an exemplary embodiment of the present invention.

Reference will now be made in detail to exemplary embodiments of the present invention, examples of which are illustrated in the accompanying drawings, wherein like reference numerals refer to like elements throughout. The embodiments are described below in order to explain the present invention by referring to the figures.

FIG. 1 is a block diagram schematically illustrating an operation by a humidity sensing unit of a microwave oven according to an exemplary embodiment of the present invention. As illustrated therein, the microwave oven comprises a humidity sensing unit 10 which senses a humidity of the steam generated while a food is cooking, and a control unit 20 which calculates a cooking time for the concerned food based on the humidity value sensed by the humidity sensing unit 10.

When a user puts a food in the cooking chamber of the microwave oven and inputs a cooking command into the control unit 20 through a key input unit (not shown), the control unit 20 drives a magnetron (not shown) according to the inputted command value to perform the cooking of the food. Thereafter, a humidity of the steam, which is generated as the food in the cooking chamber is cooked, is sensed and converted into a voltage value by the humidity sensing unit 10. The humidity value, which is converted into a voltage value by the humidity sensing unit 10, is then supplied to the control unit 20 to allow the control unit 20 to calculate a proper cooking time for the concerned food.

The humidity sensing unit 10 comprises a humidity sensor 12 which converts the humidity of the steam generated within the cooking chamber into a voltage value, and a voltage detecting unit 14 which amplifies a change in an output voltage of the humidity sensor 12.

The humidity sensor 12 is configured so that a difference in a voltage value, according to a change in humidity of the steam, can be sensed and then supplied to the voltage detecting unit 14 or a voltage compensated (hereinafter referred to as "a compensated voltage") according to a change in temperature within the cooking chamber can be supplied to the control unit 20. The voltage detecting unit 14 can amplify the difference in voltage, resulting from a change in humidity outputted from the humidity sensor 12, and supply it to the control unit 20 as a detected voltage.

The control unit 20 comprises a voltage difference calculating unit 22 which calculates a voltage difference between the compensated voltage supplied from the humidity sensor 12 and the detected voltage supplied from the voltage detecting unit 14, and a cooking time determining unit (i.e., a first time calculating unit 24 and a second time calculating unit 26 in FIG. 1) which determines a cooking time of the food to be cooked, based on the voltage difference calculated in the voltage difference calculating unit 22.

In the microwave oven according to an exemplary embodiment of the present invention, as illustrated in FIG. 1, the cooking time determining unit comprises the first time calculating unit 24 which determines an initial cooking time based on an operation of the humidity sensor 12, and the second time calculating unit 26 which calculates a remaining cooking time based on the initial cooking time calculated in the first time calculating unit 24 by reflecting a predetermined time weight based on the concerned food.

Meanwhile a microwave oven according to an exemplary embodiment of the present invention is designed so that, when a cooking command associated with a food to be cooked is inputted into the control unit 20 by a user, the control unit 20 drives a fan driving unit (not shown) to allow an exhaust fan 30 to be operated for a predetermined period of time, thereby exhausting the steam inside the cooking chamber. Owing to this operation, the remaining steam (e.g., steam at a high temperature) inside the cooking chamber resulting from a previous cooking operation may be discharged out and/or the humidity sensor 12 may be cooled. In this exemplary embodiment, the exhaust fan 30 is driven for a predetermined period of time (for example, approximately 10 seconds) after a cooking command has been inputted, so as to reduce any adverse effects due to ambient conditions such the as remaining steam, thereby preventing the sensitivity of the humidity sensor from being deteriorated.

A configuration of the humidity sensing unit 10 of a microwave oven according to an exemplary embodiment as described above will be described in detail with reference to the circuit diagram of FIG. 2.

Figure 2:
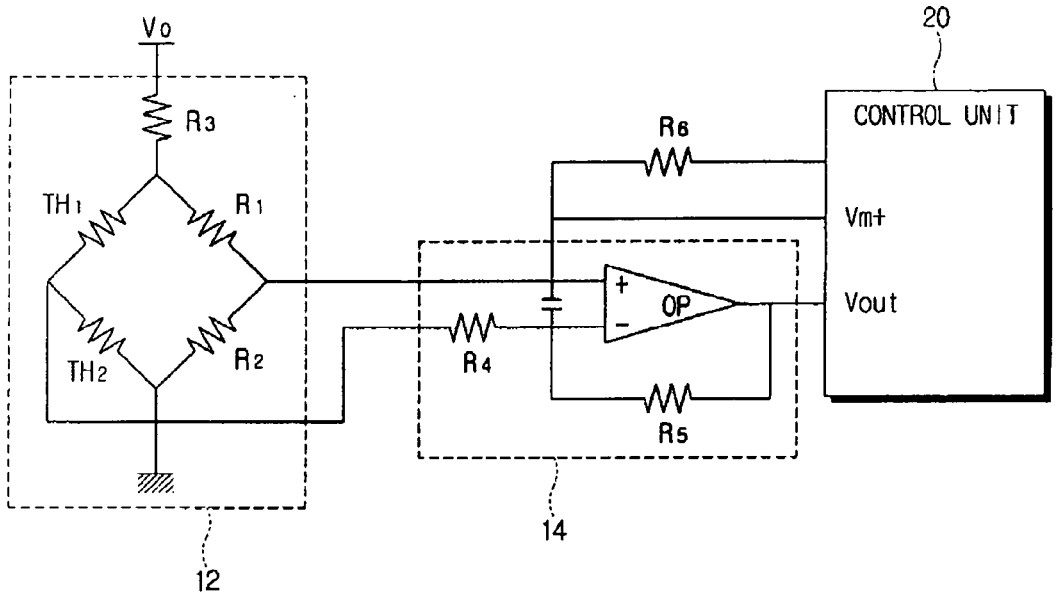
FIG. 2 is a diagram illustrating a circuit construction of the humidity sensor of FIG. 1.

As illustrated in FIG. 2, a circuit of the humidity sensing unit 10 is configured with the humidity sensor 12 including a bridge circuit comprised of thermisters $TH_1$ and $TH_2$ and resistors $R_1$ and $R_2$ to convert a humidity inside the cooking chamber into a voltage value, and the voltage detecting unit 14 including a differential amplification circuit comprised of an operational amplifier (OP amp), resistors $R_4$ and $R_5$, and a capacitor to detect a change in output voltage of the humidity sensor 12. With this configuration, the control unit 20 determines a cooking time based on predetermined voltage values (Vm, Vout) provided from the humidity sensor 12 and the voltage detecting unit 14.

The humidity sensor 12 comprises a first humidity sensor $TH_1$ being installed in an open state under which it is affected by the ambient environment, a second humidity sensor $TH_2$ connected in series to the first humidity sensor $TH_1$ for sensing a humidity in a closed state and calibrating a sensed value of the first humidity sensor $TH_1$, and a first resistor $R_1$ and a second resistor $R_2$ connected to both terminals of the first humidity sensor $TH_1$ and the second humidity sensor $TH_2$ for obtaining a change in voltage according to a sensed humidity amount.

The first humidity sensor $TH_1$ and the second humidity sensor $TH_2$ may be constructed with thermisters respectively having a negative temperature coefficient (NTC) such that values of a temperature and a resistance are inversely proportional to each other.

The voltage detecting unit 14 comprises the OP amp, which is connected to a distribution point between the first resistor $R_1$ and the second resistor $R_2$ and a distribution point between the first humidity sensor $TH_1$ and the second humidity sensor $TH_2$, for detecting a voltage difference between the two distribution points, an input resistor $R_4$ provided on an input of the OP amp, and an amplification resistor $R_5$ for amplification.

The OP amp receives a voltage ($Vm^+$) at a voltage distribution point between the first and the second resistors $R_1$ and $R_2$ at a non-inverting terminal and receives a voltage ($Vm^-$) at a voltage distribution point between the first and the second humidity sensors $TH_1$, and $TH_2$ at an inverting terminal, amplifies a voltage difference between the two received voltages at a predetermined rate of amplification according to a resistance value of the amplification resistor ($R_5$), outputs the amplified voltage difference as a detected voltage (Vout), and then supplies it to the control unit 20.

The voltage ($Vm^+$) at the voltage distribution point between the first and the second resistors $R_1$ and $R_2$ inputted into the non-inverting terminal of the OP amp refers to a compensated voltage according to a change in internal temperature of the cooking chamber and is supplied to the control unit 20. In this regard, the control unit 20 may comprise an A/D converter to process the detected voltage (Vout) and the compensated voltage (Vm) inputted from the humidity sensing unit 10.

Figure 3:
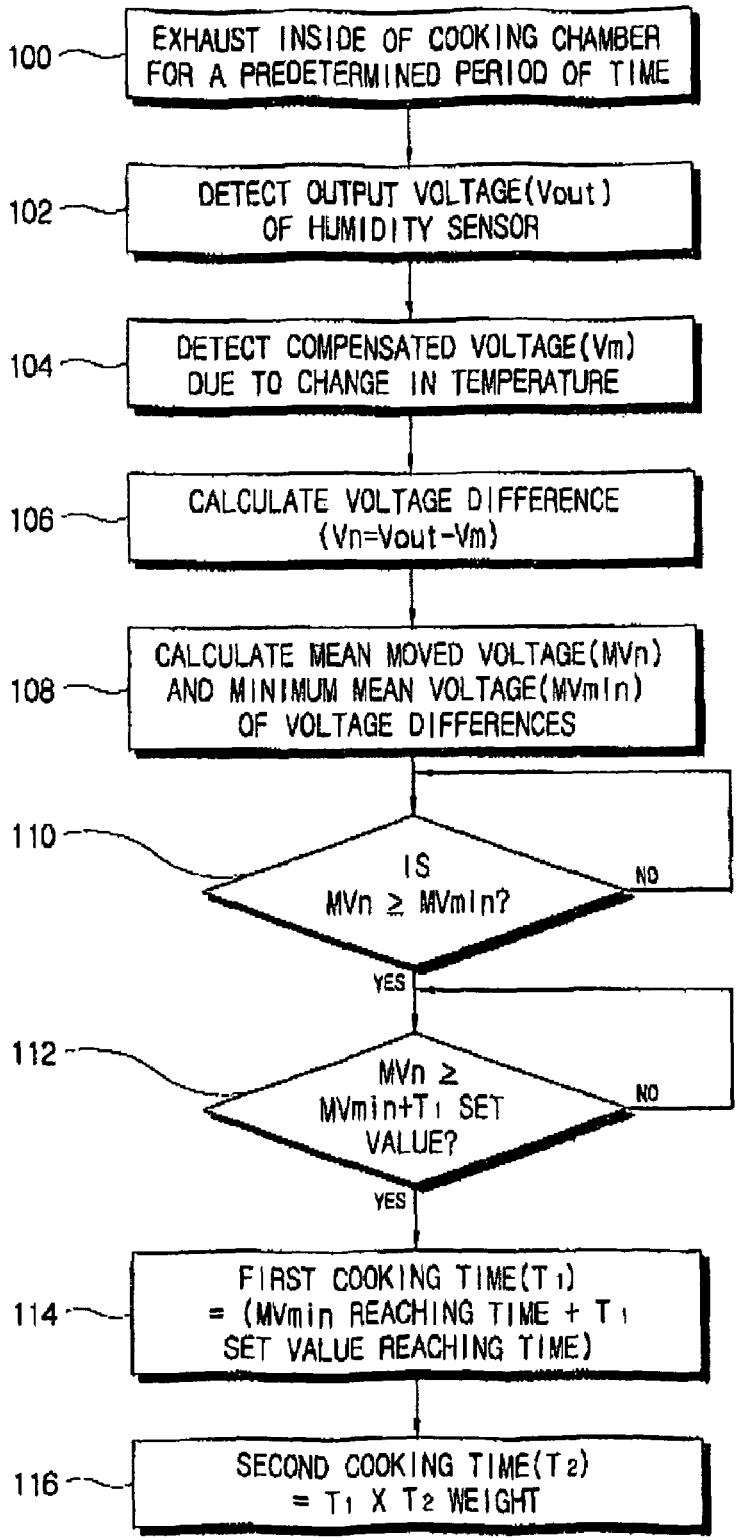
FIG. 3 is a flow chart illustrating control of a cooking time by a microwave oven according to an exemplary embodiment of the present invention.

Hereinafter a process of determining a cooking time associated with a food to be cooked based on the detected voltage (Vout) and the compensated voltage (Vm) supplied from the humidity sensing unit 10 in the microwave oven according to an exemplary embodiment of the present invention will be described in detail with reference to the control flow chart of FIG. 3.

When a user inputs a cooking command associated with a food to be cooked, the control unit 20 drives the exhaust fan 30 for a predetermined period of time to thereby exhaust the inside of the cooking chamber at operation 100. When an exhausting operation to exhaust the cooking chamber is finished, a magnetron (not shown) is driven and a heating operation to cook the food starts. Thereafter, steam generated due to heating the food is sensed by the humidity sensor 12 as humidity and converted into a voltage value. A change in the humidity sensed as time goes by causes changes in resistance values of the first and the second humidity sensors $TH_1$ and $TH_2$, and a difference between voltages at both distribution points outputted from a bridge circuit including the first and the second resistors $R_1$ and $R_2$ is inputted into the OP amp of the voltage detecting unit 14 and a detected voltage (Vout) amplified at a predetermined rate is outputted at operation 102. Also, the voltage at the distribution point between the first and the second resistors $R_1$ and $R_2$ is detected as a compensated voltage (Vm) according to a change in temperature inside the cooking chamber at operation 104. Then, the detected voltage (Vout) and the compensated voltage (Vm) are inputted into the voltage difference calculating unit 22 of the control unit 20 and the control unit 20 calculates a voltage difference Vn (Vn=Vout−Vm) at operation 106.

In an exemplary embodiment of the present invention, voltage differences (Vn) are consecutively measured at a predetermined interval of time and a plurality of mean moved voltages (MVn) are calculated by a mean movement method relative to a plurality of the intervals of time at operation 108. For example, detected voltages (Vout) and compensated voltages (Vm) are consecutively measured every second after a sensing operation by the humidity sensor 12 has started, following the magnetron being driven, to thereby calculate voltage differences (Vn), and on this basis mean moved voltages (MVn) can be calculated at an interval of every five seconds. Accordingly, the minimum value is calculated from the plurality of mean moved voltages (MVn) obtained at each time point, to thereby calculate the minimum mean voltage (MVmin). In an exemplary embodiment of the present invention, a mean voltage calculating unit may be provided so as to calculate the mean moved voltage (MVn) and the minimum mean voltage (MVmin). The mean voltage calculating unit may be provided separately from the voltage difference calculating unit 22, or it may be provided within the voltage difference calculating unit 22.

Calculation of the minimum value, namely the minimum mean voltage (MVmin), from the mean moved voltages (MVn) of the voltage differences (Vn) in an exemplary embodiment of the present invention is targeted to establish a reference value in regions where a change in input voltage or a change in output of the humidity sensor, when the magnetron is initially driven according to a cooking command from the microwave oven, is slight.

By calculating a mean moved voltage (MVn) of the voltage differences (Vn) calculated from the output voltages (Vout, Vm) of the humidity sensing unit 10 according to an exemplary embodiment of the present invention, an irregular fluctuation of the humidity sensed in the humidity sensing unit 10 may be eliminated. Additionally, by using adjacent values obtained from consecutive values of the voltage differences (Vn) measured at each time point and voltage values calculated with an application of a rule of overlapping, the voltage values sensed by the humidity sensing unit 10 are stabilized, thereby eliminating an irregular fluctuation of the humidity sensed in the humidity sensing unit 10.

Meanwhile, by consecutively calculating mean moved voltages (MVn) at each predetermined interval of time, it is determined whether any one of the calculated mean moved voltages (MVn) reaches the minimum mean voltage (MVmin) at operation 110. After a mean moved voltage (MVn) detected in the voltage difference calculating unit 22 has reached the minimum mean voltage (MVmin), it is determined whether the mean moved voltage (MVn) reaches a voltage value obtained by adding the minimum mean voltage (MVmin) to a voltage fluctuation value set in advance relative to the concerned food ($T_1$ set value) at operation 112.

If operation 112 is satisfied, the time until the mean moved voltage (MVn) has reached the minimum mean voltage (MVmin) from a predetermined time point, that is, the time to reach the minimum mean voltage (MVmin) associated with the concerned food (hereinafter referred to as the "MVmin reaching time") is calculated. The MVmin reaching time is added to the time until the mean moved voltage (MVn) has further reached the voltage including the voltage fluctuation value set in advance for the concerned food (hereinafter referred to as "$T_1$ set value reaching time"), i.e., MVmin reaching time+$T_1$ set value reaching time. The sum of these two times represents an initial cooking time associated with the concerned food (i.e., a first cooking time $T_1$) at operation 114. The voltage fluctuation value set in advance associated with the concerned food may vary based on the food being cooked.

Figure 4:
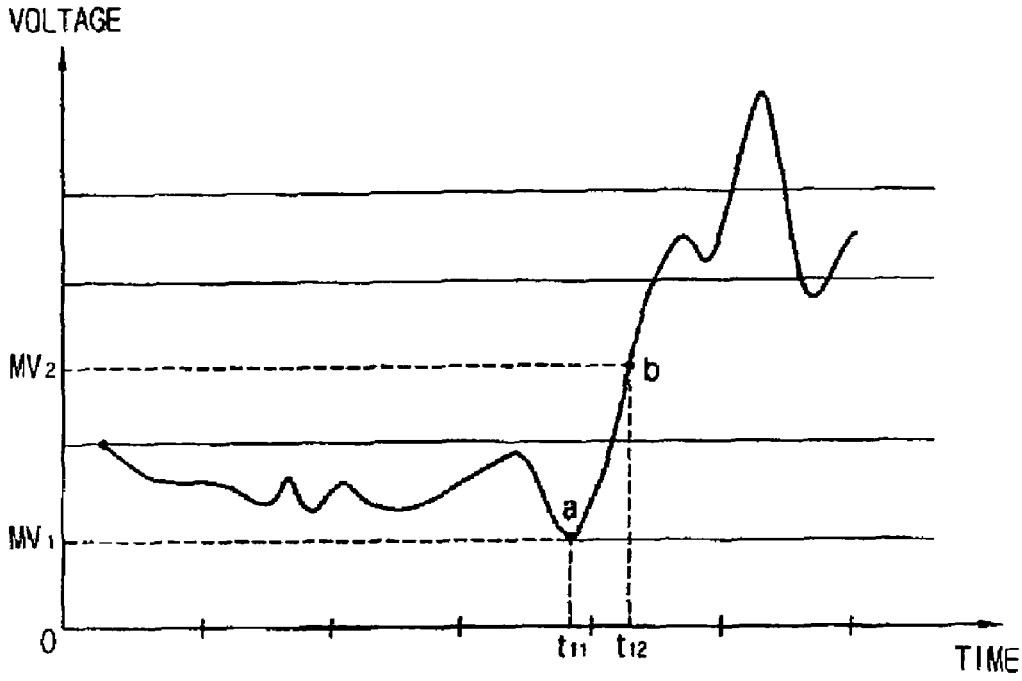
FIG. 4 is a waveform diagram illustrating determining the cooking time of the microwave oven according to an exemplary embodiment of the present invention.

Calculation of the first cooking time $T_1$ will be described by way of example with reference to a waveform diagram of a mean moved voltage (MVn) relative to a change in humidity according to time, as depicted in FIG. 4. The waveform diagram of FIG. 4 depicts a fluctuation in the mean moved voltage (MVn) at each time point. In FIG. 4, the voltage value (MV1) at the point 'a' corresponds to the minimum mean voltage (MVmin), and the time until this point in time (t11−0) corresponds to the MVmin reaching time. Also, a fluctuation in voltage from the point 'a' to the point 'b', namely ΔMV=(MV2−MV1) corresponds to the voltage fluctuation value set in advance for the concerned food, and the time until this point in time is reached (t12−t11) corresponds to the $T_1$ set value reaching time.

Accordingly, the initial cooking time (i.e., the first cooking time $T_1$) is calculated by $T_1$=[(t11−0)+(t12−t11)].

If the first cooking time ($T_1$) is calculated according to an operation of the humidity sensing unit 10 after the magnetron has been driven according to a cooking command, a second cooking time ($T_2$) is calculated by reflecting a weight ($T_2$ weight) of the remaining cooking time associated with the concerned food therein at operation 116. The weight of the remaining cooking time associated with the concerned food may be set differently based on the food being cooked. Further, according to the kind of food being cooked, a power level of the magnetron applied for the second cooking time ($T_2$) may be increased or decreased.

A predetermined time to exhaust the inside of the cooking chamber, by driving an exhaust fan 30 at an initial operation according to the cooking command, may be excluded in calculating the cooking times described above.

The voltage fluctuation value set in advance for a kind of food ($T_1$ set value) and the weight ($T_2$ weight) of the remaining cooking time may be stored in a separate storage unit provided in the control unit 20.

In an exemplary embodiment of the present invention, the humidity sensing unit 10 is designed to be operated for the duration of the first cooking time as calculated, thereby calculating a second cooking time ($T_2$), which is the remaining cooking time associated with the concerned food even though the humidity sensing unit 10 is not in operation after the first cooking time (i.e., during the second cooking time).

As described above, according to the present invention there are provided a microwave oven capable of calculating an optimal cooking time associated with each of a plurality of foods by use of a humidity sensor, and controlling a cooking time in a stable manner relative to an irregular change in humidity with the use of the humidity sensor, and a control method thereof.

Although the present invention has been described in connection with the exemplary embodiments illustrated in the accompanying drawings, it should be understood that the present invention is not limited thereto and those skilled in the art can make various modifications and changes without departing from the scope of the invention. The scope of protection accorded to the present invention is defined by the claims attached hereto and equivalents.

What is claimed is:

1. A microwave oven comprising:

a humidity sensor;

a voltage detecting unit which detects a change in an output voltage of the humidity sensor; and a control unit which receives a compensated voltage according to a change in temperature from the humidity sensor and a detected voltage from the voltage detecting unit, and determines a cooking time based on a voltage difference between the detected voltage and the compensated voltage.

2. The microwave oven as claimed in claim 1, wherein the control unit comprises:

a voltage difference calculating unit which receives the compensated voltage from the humidity sensor and the detected voltage from the voltage detecting unit, and calculates the voltage difference between the detected voltage and the compensated voltage;

a mean voltage calculating unit which repeatedly receives, at a predetermined time interval, the voltage difference from the voltage difference calculating unit to obtain a plurality of voltage differences, and calculates a plurality of mean moved voltages based on the voltage differences; and a cooking time determining unit which determines the cooking time based on a minimum mean voltage, as a mean moved voltage having the minimum value from among the mean moved voltages, and a voltage fluctuation value set in advance based on a food.

3. The microwave oven as claimed in claim 2, wherein the cooking time determining unit comprises:

a first time calculating unit which calculates a first cooking time from when the food starts to be cooked until a time when one of the mean moved voltages is equal to or greater than the sum of the minimum mean voltage and the voltage fluctuation value; and a second time calculating unit which calculates a second cooking time by applying a predetermined weight based on the food to the first cooking time, wherein the cooking time is a sum of the first cooking time and the second cooking time.

4. The microwave oven as claimed in claim 1, wherein the control unit initially operates an exhaust fan for a predetermined period of time to exhaust an interior of the cooking chamber.

5. A method of controlling a microwave oven having a humidity sensor and a voltage detecting unit which detects a change in an output voltage of the humidity sensor, the method comprising:

receiving a compensated voltage according to a change in temperature from the humidity sensor;

receiving a detected voltage from the voltage detecting unit;

calculating a voltage difference between the detected voltage and the compensated voltage;

calculating the voltage difference at a predetermined interval of time to obtain a plurality of voltage differences;

calculating a plurality of mean moved voltages based on the voltage differences; and determining a cooking time based on a minimum mean voltage, as the mean moved voltage having the minimum value from among the mean moved voltages, and a voltage fluctuation value set in advance based on a food to be cooked.

6. The method as claimed in claim 5, further comprising:

calculating a first cooking time from when the food starts to be cooked until a time when one of the mean moved voltages is equal to or greater than the sum of the minimum mean voltage and the voltage fluctuation value set in advance; and calculating a second cooking time by applying a predetermined weight based on the food to the first cooking time, wherein the cooking time is a sum of the first cooking time and the second cooking time.

7. The method as claimed in claim 5, further comprising initially exhausting an interior of a cooking chamber of the microwave oven by operating an exhaust fan for a predetermined period of time.

* * * * *